United States Patent [19]

Stanko

[11] 4,083,174

[45] Apr. 11, 1978

[54] COUPLED FALSE TWIST SPINDLE AGGREGATE ARRANGEMENT

[75] Inventor: Wayne Stephen Stanko, Clemson, S.C.

[73] Assignee: Akzona Incorporated, Asheville, N.C.

[21] Appl. No.: 799,927

[22] Filed: May 24, 1977

[51] Int. Cl.[2] ..... D02G 1/06; D01H 1/20

[52] U.S. Cl. ..... 57/77.45; 57/104

[58] Field of Search ..... 57/34 R, 77.45, 104, 57/92, 103; 74/206, 210, 214

[56] References Cited

U.S. PATENT DOCUMENTS

| | | | |
|---|---|---|---|
| 3,058,289 | 10/1962 | Raschle | 57/77.45 X |
| 3,348,370 | 10/1967 | Gassner | 57/77.45 |
| 3,385,047 | 5/1968 | Schwabe | 57/77.45 |
| 3,488,676 | 1/1970 | Bieniok | 57/77.45 |
| 3,827,229 | 8/1974 | Bieniok | 57/77.45 |
| 4,008,563 | 2/1977 | Gassner et al. | 57/77.45 |

*Primary Examiner*—Donald Watkins
*Attorney, Agent, or Firm*—Craig & Antonelli

[57] ABSTRACT

For the purpose of imparting a false twist to yarn, a spindlette, through which the yarn passes, is coupled to first and second drive wheels, each of which is affixed to a respective whorl. In order to prevent slippage between the spindlette and the drive wheels and to insure that the spindlette rotates at a uniform speed, a timing gear and belt arrangement is coupled to each of the drive wheels to synchronize the speed of rotation of the drive wheels with respect to each other.

9 Claims, 9 Drawing Figures

COUPLED FALSE TWIST SPINDLE AGGREGATE ARRANGEMENT

FIELD OF THE INVENTION

The present invention relates to a false twist spindle device for imparting false twists to synthetic yarns.

DESCRIPTION OF THE PRIOR ART

For the purpose of effecting false twist texturing of synthetic yarns, conventional false twist spindle arrangements have comprised a pair of drive wheels, each of which is mounted for rotation about an axis upon a driving whorl. In the nip between these drive wheels, a spindlette, through which yarn to be imparted with a false twist passes, is disposed. One or both of the drive wheels may be actively driven to cause rotation of the spindlette, so that as the yarn passes through the tube of the spindlette, it will be twisted by the rotation of a pin over which the yarn is wound.

FIGS. 1 and 2 of the drawings of the present application illustrate this type of known false twist spindle arrangement wherein a pair of wheels 4 and 5 are mounted upon respective whorls 6 and 7. The spindlette 1 includes a pin 2 over which the yarn 3 is wound as it moves through the spindlette. For driving one or both of the whorls, a drive belt 8 is usually employed. By frictional engagement with one or both of the whorls, either or both of the drive wheels 4 and 5 is caused to rotate to impart a similar but counter rotation to the spindlette proper.

The arrangement illustrated in FIGS. 1 and 2 is of the type descirbed in the U.S. Pat. No. to Gassner 3,348,370.

The U.S. Pat. No. to Schrenk et al. 2,855,750 describes another known type of twist device wherein a false twist element similar to element 1, shown in FIG. 1 of the drawings of the present application, is guided by a pair of rotatable wheels which act in the manner of a thrust bearing to prevent shifting of the spindle in the axial direction as well as to provide a bearing surface for rotation. In the device described in the Schrenk et al patent, rotation of the twist device proper is imparted by a driven endless belt which is urged into contact with the driving surface of te spindlette proper by a series of guide rollers. The spindlette is supported by the wheels in the manner of a thrust bearing so that the wheels provide nothing more than a support and a guide surface for rotation.

In the device described in the Gassner patent, the drive belt is coupled independently to one or both of the drive shafts which carry the drive discs for the spindlette. This independent coupling means that slippage between the drive belt and the driven shaft will result in a differential rotational speed for the drive discs leading the drawbacks discussed above.

Applicant has discovered that in a false twist spindle arrangement of the type illustrated in FIGS. 1 and 2, the spindlette will tend to rotate at the speed of the wheel rotating at the relatively slower speed, which could be either of the wheels, depending upon the degree of slippage between the belt 8 and the whorls 6 and 7. Where the belt 8 engages only one of the whorls, the spindle will tend to assume the rotational speed of the non-driven, thrust bearing-acting other drive wheel, regardless of the speed of the driven wheel. Since uniformity of spindlette speed is critical for insuring quality control in a false twist apparatus, wide variations in spindlette speed represent a serious commercial drawback.

SUMMARY OF THE INVENTION

In accordance with the present invention, applicant has provided a coupling between the drive wheels for the spindlette to prevent relative slippage between the two wheels and to insure synchronous rotation of the wheels, so that a substantially uniform speed of rotation of the spindlette can be achieved, thereby significantly improving the fiber quality and bulk uniformity, as well as reducing deterioration of the drive wheels themselves.

As a particular measure for insuring uniform speed of rotation, a pair of timing gears are respectively associated with each of the drive wheel arrangements with a timing belt coupling the gears together, so that the wheels will always be driven in synchronism, thereby preventing slippage between the wheels and maintaining uniformity of rotational speed for the spindlette.

DETAILED DESCRIPTION OF THE INVENTION

Figure 1:
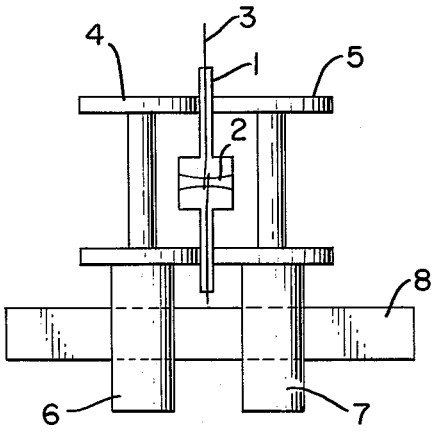
FIGS. 1 and 2 are a side view and a plan view, respectively, of a known false twist spindle arrangement.
Figure 2:
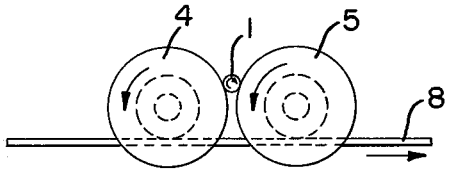
Figure 3:
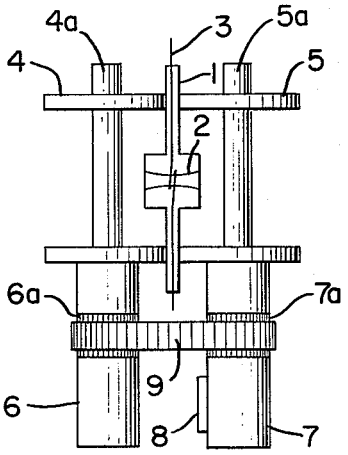
FIGS. 3 and 4 are a side view and a plan view, respectively, of a coupled false twist spindle aggregate arrangement adapted for synchronous rotation.
Figure 4:
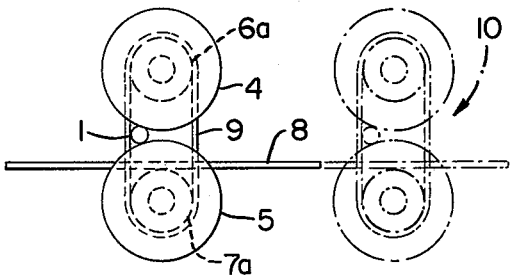

As is illustrated in FIGS. 3 and 4, the false twist spindle arrangement of the present invention employs a pair of drive whorls 6 and 7, to which respective drive wheels 4 and 5 are attached. At the nip between the drive wheels is a spindlette 1 for imparting a false twist to yarn 3, passing therethrough. Rotation of the drive whorls is effected by way of a belt 8 which frictionally engages one of the drive whorls 7. In order to insure synchronous rotation of the wheels 4 and 5, the drive whorls 6 and 7 are provided with respective timing gears **6*a* and 7*a* over which a timing belt 9 passes. The gears 6*a* and 7*a* and the belt 9** assure that both of the drive wheels rotate at the same speed, so as to reduce slipage between the drive wheels and the spindlette and to provide a more uniform spindlette speed.

Although the timing gears **6*a* and 7*a* are shown as part of the whorls 6 and 7, the timing gears can be equally placed on the hubs 4*a* and 5*a* of the drive wheels 4 and 5**, for effecting synchronous rotation of the wheels.

Also shown in the right hand portion of FIG. 4, in dotted line form, is an additional coupled spindlette aggregate 10 identical to the aggregate shown in the left hand portion of FIG. 4, and driven by the common belt 8. In accordance with the present invention, a plurality of such aggregates may be driven by a common belt and, as will be explained below, the effect provided by the synchronously driven aggregate of the present invention becomes particularly advantageous when considered from a multiple aggregate standpoint.

Figure 5:
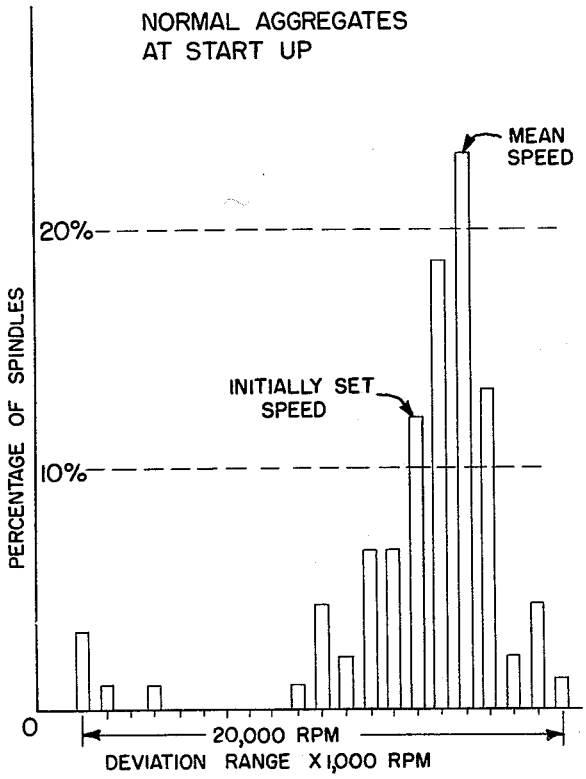
FIGS. 5 and 6 are respective graphs showing the results of tests carried out for normal spindle aggregates.
Figure 6:
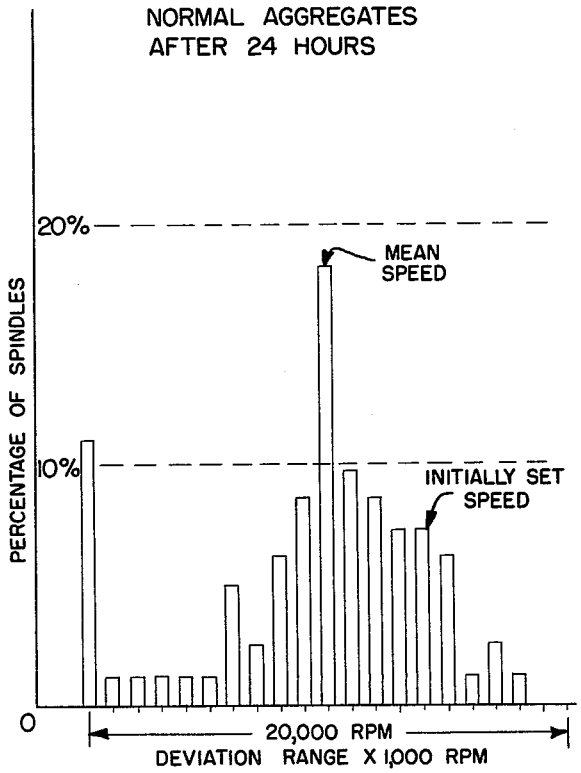

FIGS. 5 and 6 respectively illustrate graphs representing test results carried out upon a multiple normal aggregate, namely, a plurality of known aggregates, disposed side-by-side and driven by a common driving belt.

FIG. 5 illustrates the spindle speed distribution for a plurality of normal aggregates, as measured at start-up on a machine incorporating aggregates driven at high speed. The driving speed is conventionally selected in the range of 400,000 to 600,000 R.P.M. FIG. 5 shows that where a plurality of normal aggregates are driven, there is a spindle speed deviation over a range of 20,000 R.P.M. at start-up. The number of aggregates in the mean speed range exceeds 20% of the total.

After 24 hours of operation, the mean speed has dropped 6,000 R.P.M. and the range of deviation is still quite extensive, as shown within the 20,000 R.P.M. spread in FIG. 6. Furthermore, FIG. 6 shows how a significant number of aggregates have slowed down considerably, namely over 10% of the aggregates are rotating at the lowest end of the range, and the mean speed range has fallen below 20%.

Figure 7:
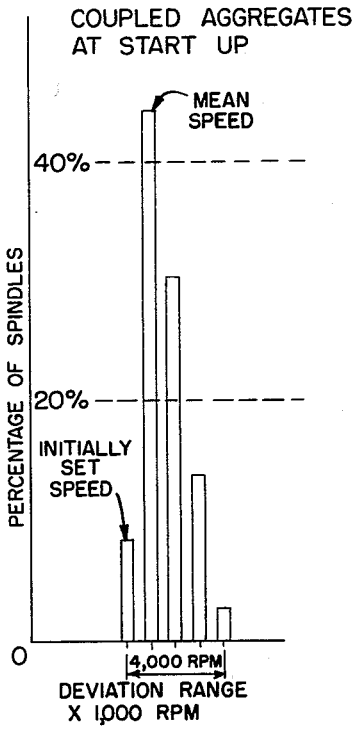
FIGS. 7 through 9 are graphs showing the results of tests carried out on the coupled spindle aggregates of the present invention.
Figure 8:
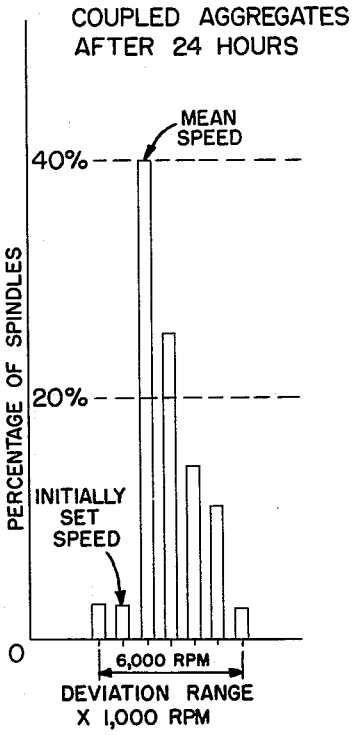
Figure 9:
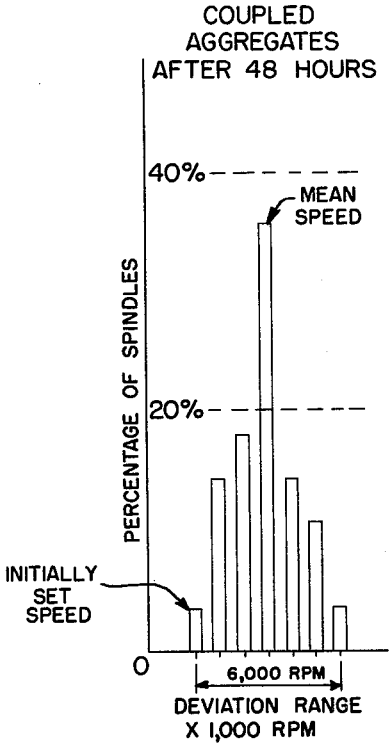

FIGS. 7 through 9 illustrate test result measurements carried out on the coupled spindlette aggregate of the present invention, at start-up, after a period of 24 hours, and after a period of 48 hours, respectively. Eighteen coupled aggregates were driven, with the speed of rotation chosen in the above range of 400,000 to 600,000 R.P.M. As is shown in FIG. 7, at start-up the percentage of spindlettes rotating at the mean speed is approximately twice that of the normal aggregates as shown in FIG. 5; also of significance is the fact that the deviation range is quite narrow, 4,000 R.P.M. After 24 hours of operation, FIG. 8 shows that the mean speed has not dropped significantly and the percentage of spindlettes rotating at the mean speed is still quite high. Even after 48 hours, as illustrated in FIG. 9. the deviation range is only 6,000 R.P.M. and the mean speed of a fairly large percentage of the spindlettes is increased, rather than having dropped.

These test results carried out on the present invention and normal aggregates, illustrated in FIGS. 5 through 9, above, demonstrate that the synchronously coupled spindle arrangement according to the present invention has a much more narrow spindlette speed distribution than independently driven arrangements of the prior art. Thus, from a standpoint of driving a multiple aggregate arrangement, significantly improved results are offered by the synchronously driven spindlette of the present invention.

While I have shown and described several embodiments in accordance with the present invention, it is understood that the same is not limited thereto but is susceptibel of numerous changes and modifications as know to a person skilled in the art, and I therefore do not wish to be limited to the details shown and described herein but intend to cover all such changes and modifications as are obvious to one of ordinary skill in the art.

I claim:

1. In a false twist spindle device having first and second spindlette driving arrangements respectively made up of first and second drive wheels respectively affixed to first and second whorls;

a spindlette, through which yarn to be false-twisted passes, coupled to said drive wheels to be driven thereby; and means, coupled to one of said whorls, for driving said one of said whorls and the drive wheel affixed thereto, thereby driving said spindlette;

the improvement comprising means for preventing said first drive wheel from rotating at a speed different from the rotational speed of said second drive wheel, said preventing means comprising synchronization means, coupled to said first and second spindlette driving arrangements, for synchronizing the speed of rotation of said first drive wheel with that of said second drive wheel, thus reducing slippage between the drive wheels and said spindlette so that said spindlette is driven at a more uniform speed.

2. The improvement according to claim 1, wherein said synchronization means comprises a timing belt, mechanically linking said first spindlette driving arrangement with said second spindlette driving arrangement.

3. The improvement according to claim 2, wherein said synchronization means further comprises first and second timing gears respectively attached to said first and second whorls, said timing belt linking said timing gears to each other.

4. The improvement according to claim 2, wherein said synchronization means further comprises first and second timing gears respectively attached to the hubs of said first and second drive wheels, said timing belt linking said timing gears to each other.

5. In a false twist spindle arrangement having a multiplicity of false twist driving arrangements, each of which includes first and second drive wheels respectively affixed to first and second whorls, a spindlette, through which yarn to be false-twisted passes, coupled to the drive wheels to be driven thereby, and means, coupled to one of the whorls of each arrangement, for driving said one of the whorls of each arrangement and the drive wheel affixed thereto, to thereby drive the multiplicity of spindlette arrangements together, a method of reducing variations in the speeds of rotation of the individual driving arrangements, comprising the step of synchronously coupling each first and second spindlette driving arrangement of said multiple spindlettes to each other, and thereby synchronize the speed of rotation of the first deive wheel with that of the second drive wheel of each arrangement, thereby reducing slippage between the drive wheels and the spindlette, so that the multiple spindlettes are driven at a more uniform speed.

6. In a multiple false twist spindle apparatus having a plurality of false twist spindle devices, each device including first and second spindlette driving arrangements respectively made up of first and second drive wheels respectively affixed to first and second whorls;

a spindlette, through which yarn to be false-twisted passes, coupled to said drive wheels to be driven thereby; and means, coupled to one of the whorls of each spindlette driving arrangement, for driving said one of said whorls and the drive wheel affixed thereto, thereby driving each of said spindlettes in common;

the improvement comprising means, associated with each spindlette driving arrangement of said multiplicity of spindle devices, for preventing the first drive wheel from rotating at a speed different from the rotational speed of said second drive wheel, said preventing means comprising synchronization means, coupled to the first and second spindlette driving arrangements, for synchronizing the speed of rotation of said first drive wheel with that of said second drive wheel, thus reducing slippage between the drive wheels and said spindlette, so that each of said spindlette of said multiplicity is driven at a more uniform speed.

7. The improvement according to claim 6, wherein said synchronization means comprises a timing belt, mechanically linking said first spindlette driving arrangement with said second spindlette driving arrangement.

8. The improvement according to claim 7, wherein said synchronization means further comprises first and second timing gears respectively attached to said first and second whorls, said timing belt linking said timing gears to each other.

9. The improvement according to claim 7, wherein said synchronization means further comprises first and second timing gears respectively attached to the hubs of said first and second drive wheels, said timing belt linking said timing gears to each other.

* * * * *